US007205081B2

(12) United States Patent
Scharfe et al.

(10) Patent No.: US 7,205,081 B2
(45) Date of Patent: Apr. 17, 2007

(54) IMAGING MEMBER

(75) Inventors: Merlin E. Scharfe, Penfield, NY (US); Richard L. Schank, Pittsford, NY (US); William W. Limburg, Penfield, NY (US); Damodar M. Pai, Fairport, NY (US); Dale S. Renfer, Webster, NY (US); John F. Yanus, Webster, NY (US); Paul J. DeFeo, Sodus Point, NY (US)

(73) Assignee: Xerox Corporation, Stamford, CT (US)

( * ) Notice: Subject to any disclaimer, the term of this patent is extended or adjusted under 35 U.S.C. 154(b) by 103 days.

(21) Appl. No.: 10/014,570

(22) Filed: Dec. 14, 2001

(65) Prior Publication Data

US 2003/0113646 A1 Jun. 19, 2003

(51) Int. Cl.
*G03G 5/047* (2006.01)
*G03G 5/147* (2006.01)

(52) U.S. Cl. ..... 430/58.8; 430/59.4; 430/64; 430/67

(58) Field of Classification Search ..... 430/58.8, 430/64, 59.4, 58.05, 67, 63, 60, 58.2
See application file for complete search history.

(56) References Cited

U.S. PATENT DOCUMENTS 3,958,207 A 5/1976 Tutihasi ..... 338/15
4,251,612 A 2/1981 Chu et al.
4,254,199 A 3/1981 Tutihasi
4,265,990 A 5/1981 Stolka et al.
4,275,132 A 6/1981 Chu et al. ..... 430/31
4,291,110 A 9/1981 Lee
4,424,267 A * 1/1984 Kondo et al. ..... 430/66
4,587,189 A 5/1986 Hor et al.
4,600,673 A * 7/1986 Hendrickson et al. ..... 430/67
4,664,995 A * 5/1987 Horgan et al. ..... 430/64

(Continued)

FOREIGN PATENT DOCUMENTS

EP 0 990 952 A2 5/2000

OTHER PUBLICATIONS

Grant, R. et al, ed. *Grant & Hackh's Chemical Dictionary*, Fifth Edition McGraw-Hill Book Co., NY (1987), pp. 293, 503, and 531.*

(Continued)

*Primary Examiner*—Janis L. Dote
(74) *Attorney, Agent, or Firm*—Eugene O. Palazzo; Fay Sharpe LLP

(57) ABSTRACT

An imaging method utilizing an imaging member containing a supporting substrate, a layer of a charge carrier injecting surface, a hole blocking layer, an optional adhesive layer, a layer of a charge carrier transport material, a layer of an charge carrier generating material, an optional charge trapping layer, a crossed linked silicone rubber, and an electrically insulating overcoating layer. The member is first charged with electrostatic charges of a first polarity, charged a second time with electrostatic charges of a polarity opposite to said first polarity in order to substantially neutralize the charges residing on the electrically insulating surface of the member and exposed to an imagewise pattern of activating electromagnetic radiation whereby an electrostatic latent image is formed. The electrostatic latent image may be developed to form a visible image which may be transferred to a receiver member. The imaging member may be reused after erasure and cleaning.

16 Claims, 1 Drawing Sheet

U.S. PATENT DOCUMENTS 4,943,508 A 7/1990 Yu
5,124,220 A * 6/1992 Brown et al. ..... 430/67
5,262,512 A * 11/1993 Yanus et al. ..... 528/181
5,316,880 A * 5/1994 Pai et al. ..... 430/58.7
5,356,743 A * 10/1994 Yanus et al. ..... 430/89
5,556,730 A * 9/1996 Nguyen ..... 430/67
5,606,396 A * 2/1997 Yu et al. ..... 399/162
5,641,599 A * 6/1997 Markovics et al. ..... 430/58.25
5,681,679 A 10/1997 Schank et al.
5,871,877 A * 2/1999 Ong et al. ..... 430/58.8
5,916,720 A * 6/1999 Springett ..... 430/63
6,165,670 A * 12/2000 Yu et al. ..... 430/130
6,177,219 B1 * 1/2001 Yuh et al. ..... 430/65
6,207,334 B1 3/2001 Dinh et al. ..... 430/58.8
6,210,767 B1 * 4/2001 Knauf ..... 428/40.1
6,277,535 B1 * 8/2001 Liu et al. ..... 430/64
6,287,737 B1 * 9/2001 Ong et al. ..... 430/58.8

OTHER PUBLICATIONS

Borsenberger, P. M., et al. Organic Photoreceptors for Imaging Systems, Marcel Dekker, Inc., NY (1993), pp. 289-292.*

Diamond, A.S., ed., *Handbook of Imaging Materials*, Msrcel Dekker, Inc., NY (1991), p. 398.*

* cited by examiner

IMAGING MEMBER

CROSS REFERENCE TO RELATED PATENTS

Attention is directed to commonly owned and assigned U.S. Pat. Nos. 4,275,132, 4,251,612, 4,265,990, 4,254,199, and 6,207,334, all of which disclose layered imaging members; the disclosure of each of these patents is totally incorporated herein by reference.

The appropriate components and processes of these patents may be selected for the present invention in embodiments thereof.

BACKGROUND OF THE INVENTION

The formation and development of images on the imaging surfaces of photoconductive materials by electrostatic means is known. One known process, more commonly known as xerography, involves the formation of an electrostatic latent image on the surface of a photosensitive plate which is usually referred to as the photoreceptor. The photoreceptor itself contains a conductive substrate containing on its surface a layer of photoconductive insulating material; and in many instances there can be used a thin barrier layer between the substrate and the photoconductive layer to prevent charge injection from the substrate into the photoconductive layer upon charging of the plate surface since if charge injection were allowed this would adversely affect the quality of the resulting image. This process involves forming an electrostatic latent image on the imaging surface of an imaging member by first uniformly electrostatically charging the surface of the imaging layer in the dark and then exposing this electrostatically charged surface to an imagewise pattern of activating electromagnetic radiation. The light-struck areas of the imaging layer are thus rendered relatively conductive and the electrostatic charge is selectively dissipated in these irradiated areas. After the photoconductor is exposed, the electrostatic latent image on this image-bearing surface is typically rendered visible with a finely divided colored marking material, known in the art as "toner". This toner will be principally attracted to those areas on the image-bearing surface, which retain the electrostatic charge and thus form a visible powder image. The electrostatic latent image may also be used in a host of other ways as, for example, electrostatic scanning systems may be employed to "read" the latent image or the latent image may be transferred to other materials by Transfer of ElectroStatic Images (TESI) techniques and stored. A developed image can be read or permanently affixed to the photoconductor where the imaging layer is not to be reused.

In the commercial "plain paper" copying systems, the latent image is typically developed on the surface of a reusable photoreceptor, subsequently transferred to a sheet of paper and then permanently affixed thereto to form a permanent reproduction of the original object. The imaging surface of the photoreceptor is then cleaned of any residual toner and additional reproductions of the same or other original objects can be made thereon.

Various types of photoreceptors are known for use in electrophotographic copying machines. For example, there are known in the art photoreceptors wherein the charge carrier generation and charge carrier transport functions are performed by discrete contiguous layers. There are also known in the art photoreceptors, which include an overcoating layer of an electrically insulating polymeric material. In conjunction with such so-called "overcoated" photoreceptors there have been proposed a number of imaging methods.

Nevertheless, as the art of xerography advances and more stringent demands are imposed upon the carrying apparatus because of increased performance standards there continue to be discovered novel imaging methods. The present application relates to a novel electrophotographic imaging method which utilizes an overcoated electrophotographic imaging member.

SUMMARY OF THE INVENTION

It is a feature of this invention to provide an imaging member and an electrophotographic imaging method thereof.

It is another feature of the invention to provide an imaging member which utilizes an overcoated photoreceptor which includes a layer of a charge carrier generator material and a layer of a charge carrier transport material.

It is yet another feature of the invention to provide an electrophotographic imaging member with a wear resistant overcoat layer.

It is a further feature of the invention to provide an electrophotographic imaging member wherein the imaging potential is created across the charge carrier generator and charge carrier transport layers only.

Another feature resides in a resilient, electrically insulating overcoating layer comprising an elastomer, the overcoating layer have an exposed imaging surface.

Aspects of the present invention relate to an imaging member comprised of a supporting substrate, an optional hole blocking layer thereover, an optional adhesive layer, a charge transport layer, a charge generating layer, an optional charge trapping layer, a cross linked silicone rubber, and a resilient, electrically insulating overcoating layer wherein the hole blocking layer is comprised of a crosslinked polymer derived from the reaction of polymer (I) and an organosilane represented by Formula (II). The hole blocking layer polymer, a hydrolyzed silane, of the present invention can be schematically represented by (Ill), which is derived from the crosslinking reaction as described in Scheme 1

Scheme 1

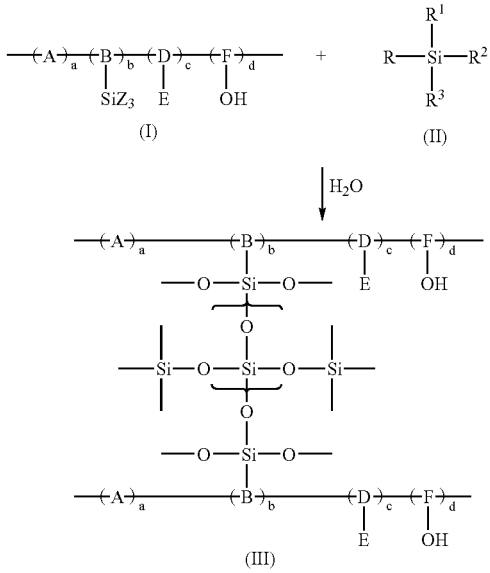

wherein E is an electron transport moiety; A, B, D and F represent the segments of the polymer backbone containing appropriate divalent linkages, which connect or bond the silyl function ($SiZ_3$), the electron transport moiety (E), and the hydroxy function (OH) to the polymer backbone; Z is selected from the group consisting of chloride, bromide, iodide, cyano, alkoxy, for example, of from about 1 to about 5 carbon atoms, acyloxy of, for example, from about 2 to about 6 carbon atoms, aryloxy of, for example, from about 6 to about 10 carbon atoms; a, b, c, and d are mole fractions of the repeating monomer units wherein a+b+c+d is equal to about 1; R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halogen; a hole blocking layer wherein a is from about 0 to about 0.95, b is from about 0.001 to about 0.50, c is from about 0 to about 0.50, and d is from about 0.01 to about 0.95; a hole blocking layer wherein A is selected from the group of divalent linkages, such as alkylene, arylene, alkoxycarbonylalkylene, alkoxycarbonylarylene, and the like; B, D and F are independently selected from the group consisting of, for example,

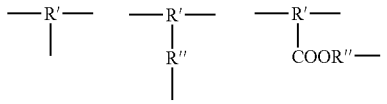

wherein R' and R" are independently trivalent linkages or divalent linkages of from about 2 to about 24 carbon atoms is provided.

In a second aspect, the present invention relates to an imaging member wherein the supporting substrate contains a charge injecting surface which is comprised of carbon, graphite or gold with a substrate thickness of from about 75 micrometers to from about 275 micrometers and wherein the substrate is flexible, seamless, or rigid. The substrate can be of different configurations comprising a plate, a cylindrical drum, a scroll, or an endless flexible belt.

In another aspect of the present invention the adhesive layer is present and is of a thickness of from about 0.001 micrometers and about 0.2 micrometers.

In yet another aspect of the present invention the charge transport layer is present and contains aryl amines of the formula

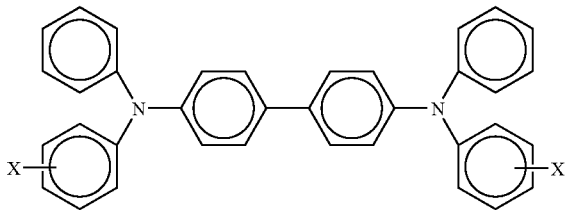

wherein X is selected from the group consisting of alkyl and halogen, and wherein the aryl amine contains X, wherein when X is alkyl, X comprises from about 1 to about 12 carbons atoms and the aryl amine is dispersed in a highly insulating and transparent resinous binder. The charge transport layer is of a thickness of from about 10 micrometers to about 75 micrometers. The charge transport layer can comprise photoconductive particles of hydroxygallium phthalocyanine and a charge transporting polymer comprising polyethercarbonate (PEC).

In a further aspect of the present invention the charge generating layer can be of a thickness of from about 0.2 micrometers to about 0.7 micrometers and comprises photoconductive particles dispersed in a film forming binder.

Still yet another aspect of the present invention relates to a cross-linked silicone which prior to cross linking is dimethyl polysiloxane hydrolyzate. Above the cross-linked silicone can be an overcoating layer, substantially transparent to activating radiation, electrically insulating, and of a thickness of from about 5 micrometers to about 10 micrometers.

In operation, in embodiments the member is charged a first time with electrostatic charges of a first polarity, charged a second time with electrostatic charges of a polarity opposite to the first polarity to substantially neutralize the charges residing on the electrically insulating surface of the member and exposed to an imagewise pattern of activating electromagnetic radiation whereby an electrostatic latent image is formed. The electrostatic latent image may be developed with a toner to form a visible image which may be transferred to a receiver member. Subsequently, the imaging member may be reused to form additional reproductions after erasure and cleaning steps are carried out.

BRIEF DESCRIPTION OF THE DRAWINGS

For a better understanding of the invention and further features thereof, reference is made to the following Figures.

Figure 1:
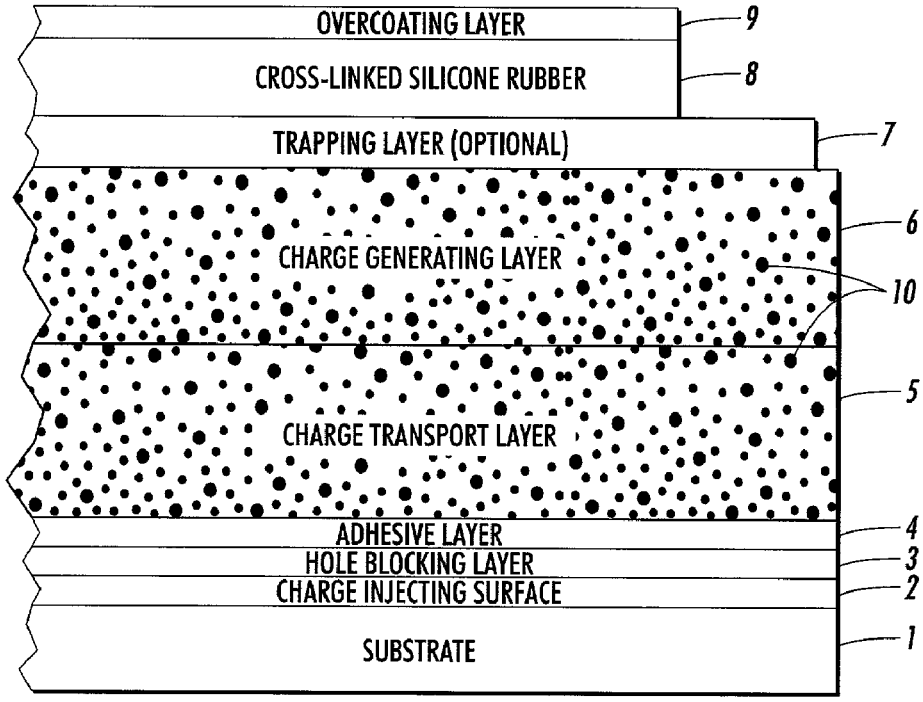
FIG. 1 is a cross-sectional view of a multilayered imaging member containing a substrate 1, a charge injecting surface 2, a hole blocking layer 3, an optional adhesive layer 4, a charge transport layer 5, a charge generating layer 6, an optional trapping layer 7, a cross-linked silicone rubber layer 8 and an overcoating layer 9. An insulating and transparent resinous binder 10 is dispersed throughout the charge transport layer and the charge generating layer.
Figure 2:
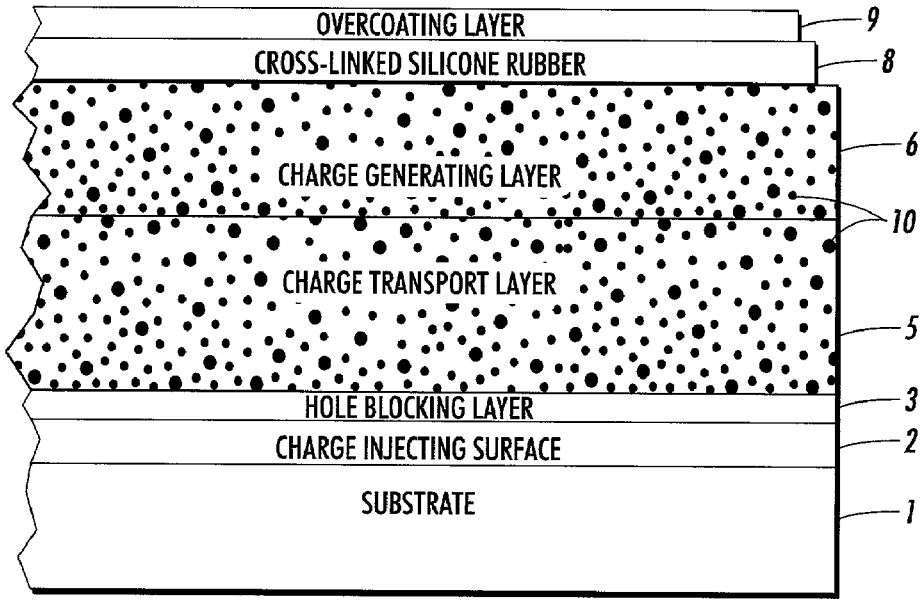

Charge negatively, wherein a corotron places negative charges on top of the overcoating layer 9 and the positive charges are placed at the injecting contact; these charges are injected into the transport layer and travel to the interface between the generator layer 6 and the overcoat layer 9, as shown FIG. 2.

Charge positively, where positive charges placed on the top surface of the charge generating layer 6, neutralize the negative charges. The negative charges placed at the injecting contact remain in place.

The net effect of the above enables the charging of the inverted active matrix, active transport structure. This is image wise exposed and developed, wherein the property of the conformable overcoat permits direct image transfer to paper while at the same time being liquid immersion development resistant.

FIG. 2 is a cross-sectional view of another specific multilayer imaging member, that does not contain an adhesive layer 4 or a charge trapping layer 7.

DESCRIPTION OF EMBODIMENTS

Specific embodiments of the present invention relate to an imaging member containing in the following sequence a supporting substrate; a hole blocking layer; an optional adhesive layer; a charge transport layer; a photogenerating layer, an optional charge trapping layer, a cross-linked silicone rubber, and a resilient, electrically insulating overcoating layer; an imaging member wherein the supporting substrate has a charge injecting surface; an imaging member wherein the supporting substrate has a thickness of about 75 to about 275 microns; an imaging member wherein the charge injecting surface containing carbon, graphite, or gold; an imaging member wherein the hole blocking layer contains a crosslinked polysiloxane polymer network impregnated with a hydroxy-functionalized polymer and photogenerating pigments; an imaging member wherein the hole blocking layer contains a hydroxy-functionalized polymer intertwined in a crosslinked polysiloxane network generated from crosslinking an organosilane reagent represented by Formula (I) or (II) below, optionally in the presence of a suitable silane crosslinking catalyst of, for example, an organoamine of, for example, triethylamine or carboxylic acid of, for example, acetic acid (I)

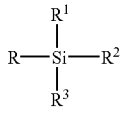

wherein R is alkyl with, for example, from about 1 to about 20 carbon atoms, or aryl with, for example, from about 6 to about 30 carbon atoms; $R^1$, $R^2$, and $R^3$ are each independently selected from the group comprising, for example, alkoxy of, for example, from about 1 to about 12 carbon atoms, aryloxy of, for example, from about 6 to about 24 carbon atoms, acyloxy of, for example, from about 2 to about 20 carbon atoms, halide, cyano, amino, and the like; an imaging member wherein the hole blocking layer is of a thickness of about 0.001 to about 5 microns, or is of a thickness of about 0.1 to about 5 microns; an imaging member wherein the hole blocking layer contains a polyester with an $M_w$ of about 70,000, and an $M_n$ of about 35,000; an imaging member wherein the adhesive layer contains a polyester with an $M_w$ of, for example, from about 20,000 to about 100,000, and more specifically, about 35,000, and an $M_n$ of from about 10,000 to 50,000, and more specifically, about 14,000; an imaging member wherein the adhesive layer is of a thickness of about 0.001 to about 0.2 micrometers; an imaging member wherein the transport layer is of a thickness of from about 10 to about 75 microns; an imaging member wherein the charge transport layer contains aryl amine molecules; an imaging member wherein the aryl amines are of the formula

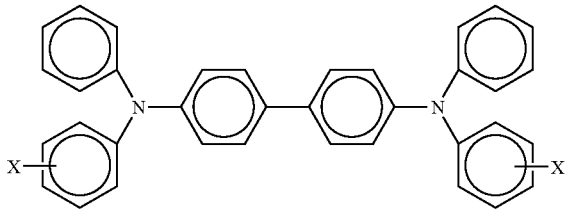

wherein X is selected from the group consisting of alkyl and halogen, and wherein the aryl amine is dispersed in a highly insulating and transparent resinous binder; an imaging member wherein the arylamine alkyl contains from about 1 to about 12 carbon atoms; an imaging member wherein the arylamine alkyl contains from 1 to about 5 carbon atoms; an imaging member wherein the arylamine alkyl is methyl, wherein halogen is chloride, and wherein the resinous binder is selected from the group consisting of polycarbonates and polystyrenes; an imaging member wherein the photogenerator layer is of a thickness of from about 0.2 to about 0.7 microns; an imaging member wherein the photogenerating layer contains photogenerating pigments dispersed in a resinous binder in an amount of from about 10 percent by weight to about 95 percent by weight; an imaging member wherein the resinous binder is selected from the group consisting of polyesters, polyvinyl butyrals, polycarbonates, polystyrene-b-polyvinyl pyridines, and polyvinyl formals; an imaging member wherein the aryl amine is N,N'-diphenyl-N,N-bis(3-methylphenyl)-1,1'-biphenyl-4,4'-diamine; an imaging member wherein the photogenerating layer contains metal phthalocyanines, metal free phthalocyanines or mixtures thereof; an imaging member wherein the photogenerating layer contains titanyl phthalocyanines, perylenes, such as Benzimidazole Perylene or Bis(benzimdazole) (BZP), or hydroxygallium phthalocyanines; an imaging member wherein the photogenerating layer contains Type V hydroxygallium phthalocyanine; a method of imaging which contains the generation of an electrostatic latent image on the imaging member, developing the latent image with a known dry toner, and transferring the developed electrostatic image to a suitable substrate; an imaging member wherein the charge trapping layer may include polyvinylbutyral, organosilanes, epoxy resins, polyesters, polyamides, polyurethanes, silicones, or polysiloxane; and an imaging member wherein the resilient, electrically insulating overcoating layer has a thickness between about 5 microns and about 10 microns.

Illustrative examples of substrate layers selected for the imaging members of the present invention can be opaque or substantially transparent, and may contain any suitable material having the requisite mechanical properties. Thus, the substrate may contain a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness. In embodiments, the thickness of this layer can be from about 75 microns to about 275 microns.

An optional electron blocking layer for positively charged photoreceptors allows, for example, holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2 N(CH_2)_4] CH_3 Si(OCH_3)_2$, (gamma-aminobutyl) methyl diethoxysilane, and $[H_2 N(CH_2)_3]CH_3 Si(OCH_3)_2$ (gamma-aminopropyl) methyl diethoxysilane, as disclosed in U.S. Pat. Nos. 4,338,387, 4,286,033 and 4,291,110. The disclosure of each of these patents is totally incorporated herein by reference. A specific hole blocking layer is generated from the reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity (RH).

The imaging member, in an embodiment, is prepared by depositing on the metal oxide layer of a metal conductive layer, a coating of an aqueous solution of the hydrolyzed aminosilane at a pH of from about 4 to about 10, drying the reaction product layer to form a siloxane film and applying an adhesive layer, and thereafter applying electrically operative layers, such as a photogenerator layer and a hole transport layer, to the adhesive layer. The blocking layer should be continuous and have a thickness of less than about 0.5 micrometer because greater thicknesses may lead to undesirably high residual voltage. A hole blocking layer of about 0.005 micrometer and about 0.3 micrometer can be specified because charge neutralization after exposure is facilitated and optimum electrical performance is achieved. A thickness from about 0.03 micrometers to about 0.06 micrometers optimizes electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is more specifically applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

Optionally, intermediate layers between the blocking layer and the adjacent charge generating and photogenerating layer may be desired to promote adhesion. For example, an adhesive layer may be employed. If such layers are utilized, they more specifically have a dry thickness of from about 0.001 micrometer to about 0.2 micrometer. Typical adhesive layers include film-forming polymers such as polyester, du Pont 49,000 resin (available from E. I. du Pont de Nemours & Co.), VITEL-PE100™ (available from Goodyear Rubber & Tire Co.), polyvinylbutyral, polyvinylpyrrolidone, polyurethane, polymethyl methacrylate, and the like. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially the hole transporting layer, which generally is of a thickness of from about 5 microns to about 75 microns, and more specifically of a thickness of from about 10 microns to about 40 microns, include molecules of the following formula

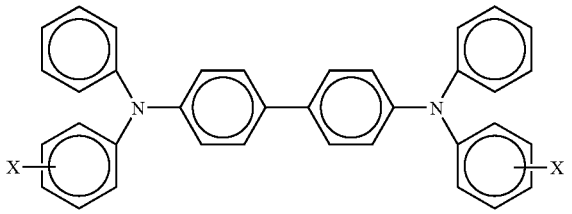

dispersed in a polymer binder, wherein X is an alkyl group, a halogen, or mixtures thereof, especially wherein the substituents are selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is more specifically a chloro substituent. Other known charge transport layer molecules can be selected, reference for example U.S. Pat. Nos. 4,921,773 and 4,464,450, the disclosures of which are totally incorporated herein by reference.

Examples of the polymer binder materials selected for the transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders in embodiments contain polycarbonate resins having a weight average molecular weight, Mw of from about 20,000 to about 100,000 with a weight average molecular weight, Mw of from about 50,000 to about 100,000 being particularly preferred. Generally, the transport layer contains from about 10 to about 75 percent by weight of the charge transport material, and more specifically from about 35 percent to about 50 percent of this material.

The photogenerating layer is comprised of a number of components, such as phtalocyanines, selenium, perylenes, hydroxygallium phthalocyanine, especially Type V, containing, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene (BZP), titanyl phthalocyanines, and the like, and more specifically vanadyl phthalocyanines, Type V hydroxygallium phthalocyanines, and inorganic components such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 microns to about 10 microns, and more specifically, from about 0.2 microns to about 0.7 micron when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin, present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns and more specifically from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and more specifically from about 25 to about 60 percent by weight of the photogenerator layer.

Suitable charge blocking layers may be interposed between the conductive layer and the photogenerating layer. Typical blocking layers include polyvinylbutyral, organosilanes, epoxy resins, polyesters, polyamides, polyurethanes, silicones and the like. Charge blocking layers preferably have a dry thickness between about 20 Angstroms and about 2,000 Angstroms.

The silane reaction product described in U.S. Pat. No. 4,464,450 is an example of a blocking layer material with extended cyclic stability. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltri methoxysilane, N-2-aminoethyl-3-aminopropyltris(ethylethoxy) silane, p-aminophenyl trimethoxysilane, 3-aminopropyidiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl [2-(3-trimethoxysilylpropylamino)ethylaminoj-3-proprionate, (N,N'dimethyl3-amino)propyltriethoxysilane, N,N dimethylaminophenyltriethoxysilane, trimethoxysilylpropyldiethylenetriamine and mixtures thereof.

In embodiments, the reaction product of a hydrolyzed silane and metal oxide layer forms a blocking layer having a thickness between about 20 Angstroms and about 2,000 Angstroms.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. A purpose of this layer is to prevent charge injection from the substrate during and after charging. This layer is of a thickness of less than from about 50 Angstroms to about 10 microns, preferably being no more than about 2 microns.

The insulative layer contains a highly cross-linked silicone rubber similar to methoxy cured RTV™, available from E.I. duPont deNemours and Company. The cross-linked silicone layer may be of a thickness of from about 5 micrometers to about 10 micrometers based upon the asperity size, the modulation transfer function resulting from the field pattern, and the dielectric properties of the material.

The overcoating layer can be a resilient, electrically insulating overcoating layer. The overcoating layer may contain organic polymers or inorganic polymers that are electrically insulating or slightly conductive. The overcoating layer may be of a thickness of from about 2 micrometers to about 8 micrometers, and more specifically from about 3 micrometers to about 6 micrometers, or from about 3 micrometers to about 5 micrometers.

EXAMPLE

An illustrative photoresponsive imaging device with the charge blocking layer was fabricated as follows.

On a 75 micron thick titanized MYLAR® substrate was coated by draw bar technique a hole blocking layer from a solution of 0.32 gram of 3-aminopropyltrimethoxysilane in 9.2 grams of an 86.1/10.4/3.5 (by weight percent) mixture of tetrahydrofuran/ethanol/water. After drying at 135° C. for 15 minutes, a hole blocking layer encompassed by Formula (III) of a thickness of about 0.5 to 0.7 micron was obtained. Overcoated on the top of the blocking layer was a 0.05 micron thick adhesive layer prepared from a solution of 2 weight percent of a DuPont 49K (49,000) polyester in dichloromethane. A 0.2 micron photogenerating layer was subsequently coated on top of the adhesive layer from a dispersion of hydroxy gallium phthalocyanine Type V (0.46 gram) and a polystyrene-b-polyvinylpyridine block copolymer binder (0.48 gram) in 20 grams of toluene, followed by drying at 100° C. for 10 minutes. Subsequently, a 25 micron charge transport layer (CTL) was coated on top of the photogenerating layer from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

Although the invention has been described with respect to embodiments, it is not intended to be limited thereto but rather those skilled in the art will recognize that variations and modifications including equivalent, substantial equivalents, similar equivalents, and the like may be made therein which are within the spirit of the invention and the scope of the claims.

What is claimed is:

1. A positively charged imaging member comprising, in sequence:

a supporting substrate, a hole blocking layer including a crosslinked polysiloxane polymer network impregnated with a hydroxy-functionalized polymer and photogenerating pigments, an optional adhesive layer, a charge transport layer, a charge generating layer, an optional charge trapping layer, a cross linked silicone rubber layer, and a resilient, electrically insulating overcoating layer.

2. An imaging member according to claim 1 wherein the substrate is of a thickness of from about 75 micrometers to from about 275 micrometers and wherein the substrate is flexible, seamless, or rigid.

3. An imaging member according to claim 1 wherein the substrate can be of different configurations, comprising a plate, a cylindrical drum, a scroll, or an endless flexible belt.

4. An imaging member according to claim 1 wherein the hole blocking layer is continuous and is of a thickness of from about 0.001 micrometers to about 5 micrometers.

5. An imaging member according to claim 4 wherein the hole blocking layer is continuous and is of a thickness of from about 0.005 micrometers to about 0.3 micrometers.

6. An imaging member according to claim 1 wherein the adhesive layer is present and is of a thickness of from about 0.001 micrometers and about 0.2 micrometers.

7. An imaging member according to claim 1 wherein the charge transport layer contains aryl amine molecules.

8. An imaging member according to claim 7 wherein the charge transport layer contains aryl amines of the formula

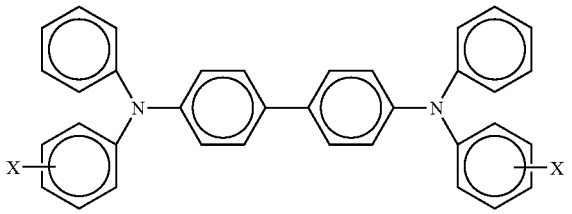

wherein X is selected from the group consisting of alkyl and halogen, and wherein the aryl amine is dispersed in a highly insulating and transparent resinous binder.

9. An imaging member according to claim 8 wherein when X is alkyl, X contains from about 1 to about 12 carbon atoms.

10. An imaging member according to claim 8 wherein the charge transport layer is of a thickness of from about 10 micrometers to about 75 micrometers and X is alkyl containing from about 1 to about 5 carbon atoms.

11. An imaging member according to claim 1 wherein the charge transport layer contains a charge transporting polymer.

12. An imaging member according to claim 11 wherein the charge transporting polymer is polyethercarbonate (PEC).

13. An imaging member according to claim 1 wherein the charge generating layer contains photoconductive particles of hydroxygallium phthalocyanine and wherein said photoconductive particles are dispersed in a film forming binder.

14. An imaging member according to claim 1 wherein the charge generating layer is of a thickness of from about 0.2 micrometers to about 0.7 micrometers.

15. An imaging member according to claim 1 wherein the overcoating layer is of a thickness from about 5 micrometers to about 10 micrometers.

16. An imaging member according to claim 1 wherein the overcoating layer is substantially transparent to activating radiation and electrically insulating.

* * * * *